US005931358A

United States Patent [19]

Rogers

[11] Patent Number: 5,931,358

[45] Date of Patent: Aug. 3, 1999

[54] ADJUSTABLE HOLSTER

[75] Inventor: William H. Rogers, Jacksonville, Fla.

[73] Assignee: Safariland Ltd, Inc., Ontario, Calif.

[21] Appl. No.: 08/971,393

[22] Filed: Nov. 17, 1997

[51] Int. Cl.[6] ..... F41C 33/02

[52] U.S. Cl. ..... 224/243; 224/245; 224/911

[58] Field of Search ..... 224/193, 242, 224/243, 245, 911; D3/222

[56] References Cited

U.S. PATENT DOCUMENTS

| | | | |
|---|---|---|---|
| 3,252,639 | 5/1966 | Sloan | 224/243 |
| 3,923,214 | 12/1975 | Kippen | 224/243 |
| 4,225,067 | 9/1980 | Bianchi et al. | 224/243 |
| 4,750,656 | 6/1988 | Bianchi et al. | 224/911 |
| 4,846,383 | 7/1989 | Gallagher | 224/243 |
| 5,351,868 | 10/1994 | Beletsky et al. | 224/245 |
| 5,570,830 | 11/1996 | Nichols | 224/243 X |

*Primary Examiner*—Renee S. Luebke

*Attorney, Agent, or Firm*—Arthur G. Yeager

[57] ABSTRACT

An adjustable holster for accommodating a variety of handguns of differing sizes and shapes includes a rigid front spine member and two substantially rigid spine members and two sidewalls. At least one of the sidewalls is constructed of flexible interior, exterior, and core layers wherein the core layer is made of resiliently deformable material that will not stretch. An adjacent member mounted between the rear spine members carries a movable engaging element that contacts a handgun and forces it forwardly against the front of the holster. An upper adjustment screw mounted between the rear spine members is used to pull the spine members and sidewalls together to adjust the draw of the handgun. A lower adjustment screw mounted between the rear spine members is used to pull the rear spine members and sidewalls together to narrow the lower opening of the holster for different size guns. The sidewalls are flexible but not stretchable in order to accommodate a variety of gun widths without the need for repeated adjustment for the specific gun in use.

24 Claims, 6 Drawing Sheets

ADJUSTABLE HOLSTER

CROSS REFERENCE TO RELATED APPLICATIONS

HANDGUN HOLSTER, Ser. No. 08/907,978, filed Aug. 11, 1997, and ADJUSTABLE CARRIER (Atty No. D-6868, filed concurrently herewith), both invented by William H. Rogers and Norman E. Clifton, Jr.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to holsters for handguns and particularly to holsters that are adjustable to accommodate a wide variety of handguns of different sizes.

2. Description of the Related Art

There are a wide variety of handgun holsters known to the prior art. They are, however, very limited in the capacity to accommodate handguns of different sizes. A holster must securely grasp a handgun, particularly when no top restraining strap is provided, and also provide for controlled or rapid drawing of the handgun. These needs severely restrict the capability of prior art holsters to adjust to handguns of different sizes. A particular prior art holster included an intermediate layer of compressible foam between the outside layer and the inside layer. While such a holster may be somewhat acceptable to accommodate various sizes and shapes of handguns, the draw (or more correctly the frictional resistance to draw the handgun) is not adjustable and the larger handgun normally would increase the frictional resistance. Also, various weather conditions, including moisture, heat, cold, etc. have serious effects thereon which could not be compensated by such prior art holster. In fact, none of the prior art holsters are satisfactory in the necessary respects envisioned herein.

BRIEF SUMMARY OF THE INVENTION

In one aspect of the present invention there is provided an adjustable holster comprising a body formed of a pair of elongated sidewalls joined by an elongated front rigid spine member and defining an interior space for a handgun. Each said sidewall has an elongated rear rigid spine member therealong. One sidewall is formed of at least one layer of resiliently deformable non-compressible material which is flexible and substantially unstretchable. An adjustable securing means for securing the rear spine members together is provided along with a selective adjustment means mounted to one rear spine member inside the interior space of the holster for selectively engaging a handgun located in the interior space to accommodate different shapes and sizes in the holster. There is also an attachment means adapted to secure the holster to a strap to be carried by a user of the holster.

Other aspects of the invention are the selective adjustment means including a rigid body member and a movable engaging member carried by the body member and means for moving the engaging member against a surface of a handgun locatable in the holster for forcing a handgun against the front spine member to secure a handgun inside. The front spine member has a predetermined contour being formed to frictionally contact a handgun at two spaced apart locations when placed in the holster for securing a handgun in the holster. The adjustable securing means includes a first adjustable fastener connecting rear spine members together at upper portions thereof for selectively pulling the upper portions together, and a second adjustable fastener connecting the rear spine member at lower portions thereof for selectively pulling the lower portions together.

Additional aspects of the present invention include an adjustable holster comprising a body formed of a pair of sidewalls joined by a front rigid spine member and defining an interior space for a handgun, each sidewall having a rear substantially rigid spine member and being formed of interior, exterior and core layers of deformable material. The core layer is located between the interior and exterior layers and is made of resiliently deformable material that is flexible and substantially nonstretchable. There is also an adjustable securing means for securing the rear spine members together and selective adjustment means mounted to the holster inside the interior space of the holster for selectively engaging a handgun located in the interior space to cause the holster to secure handguns of different shapes and sizes in the holster. There is provided attachment means for connecting the holster to a strap worn by a user of the holster.

Further aspects of the holster include the rear spine members having upper portions each having a first passageway therethrough and selective adjustment means which comprises a rigid body member having a lower portion and an upper portion each having opposite sidewalls and a second passageway therethrough. The upper portion is narrower in width than the lower portion to define a space between the upper portions of the rear spine members and the opposite sidewalls of said body member. Selective adjustment means includes securing means positioned through both the first passageways and the second passageway for pulling the body member toward each other and the sidewalls of the body member toward each other to selectively narrow the interior space for adjusting the frictional engagement between the sidewalls of the holster and a handgun locatable in the space.

The selective adjustment means includes a rigid body member and a movable engaging member carried by the body member and means for moving the engaging member against a surface of a handgun locatable in holster for forcing a handgun against the interior layer adjacent the front spine member to secure a handgun inside the holster. There is an engaging member which includes a movable arm member having an upper portion and a lower portion and pivot means for pivotally mounting the arm member to the body member at the lower portion of the arm member. The engaging member includes a rotatable wheel with axle means carried by the upper portion of the arm member for rotatably mounting the wheel thereon. The engaging member is used to force a handgun forwardly. The front spine member is formed to frictionally contact a handgun placed inside the holster at two spaced locations, one said location being on the back top of a handgun and another said location being at the front top of a handgun.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
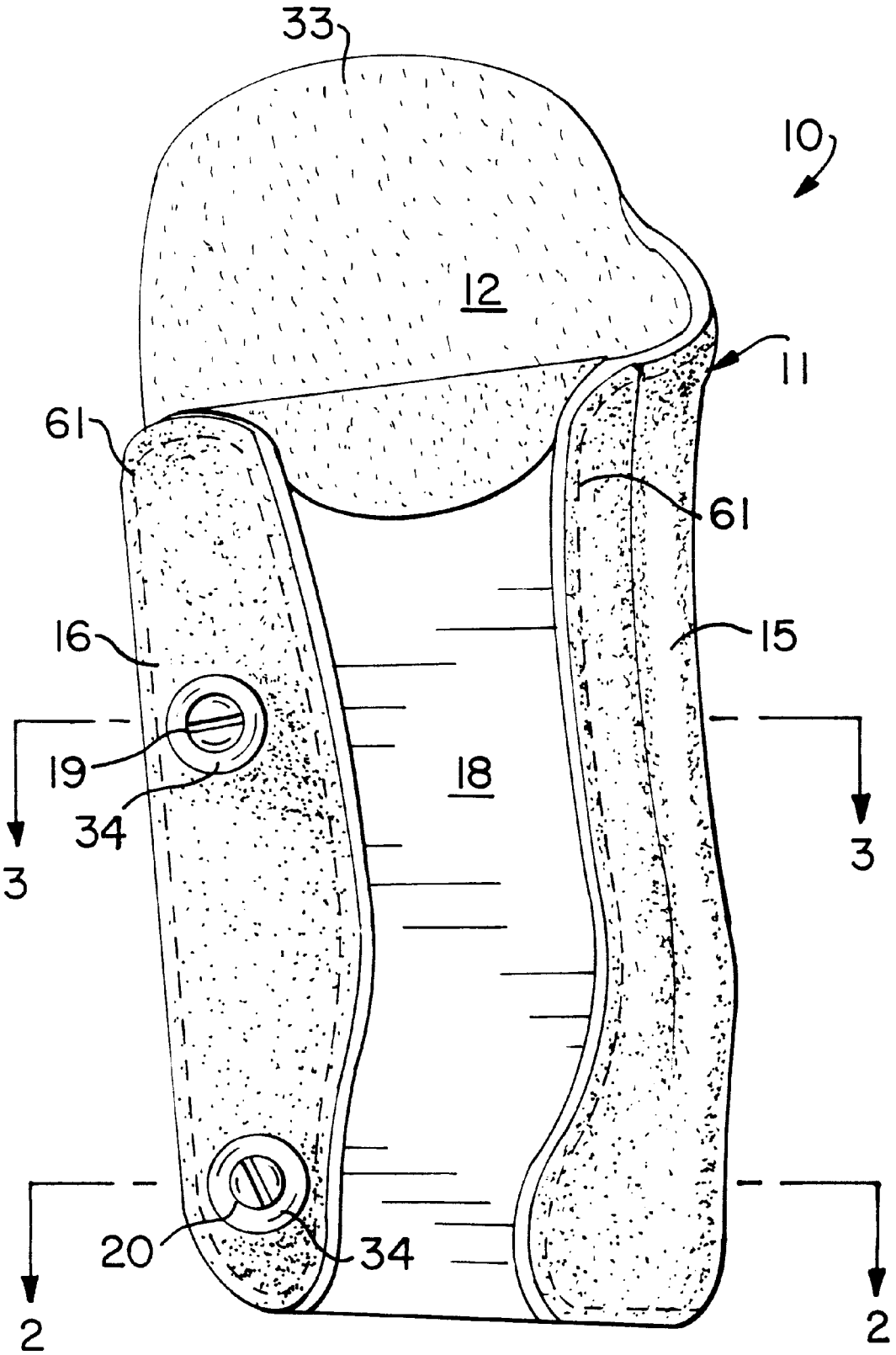
FIG. 1 is a front elevational view of the adjustable holster according to the present invention.

With reference now to the drawings, an elevation of the holster in accord with the preferred embodiment of the present invention is illustrated generally by numeral 10. The holster 10 includes a body 11 with a front rigid spine member 15, a pair of substantially rigid rear spine members 16, and an inside sidewall 17 adjacent to a wearer and an outside sidewall 18 spaced away from the wearer (see also FIGS. 2, 3 and 6).

The holster body 11, with respect to sidewalls 17 and 18, is constructed of an interior suede-like, or other non-marring material 12 and an exterior material 13 of leather, plastic, canvas or the like, and a core material 14 made of ballistic nylon, Kevlar (trademark of the Dupont Company) or other material that is not stretchable and substantially unaffected by weather conditions to provide that the respective sidewalls 17 and 18 be resiliently deformable or flexible without being stretchable. Stitching 61 is used to secure the sidewalls to the spines. This construction provides for the capability of the holster 10 to carry handguns of different sizes and shapes without the need for continuous adjustment for any particular gun carried in such holster. Each of the layers of sidewalls 17 and 18 is deformable while the core material 14 is also highly resistant to stretching. The handguns for which the holster 10 is designed are semi-automatic pistols but the basic design is adaptable to revolvers without changes except those readily discernible by persons having ordinary skill in the art.

Figure 2:
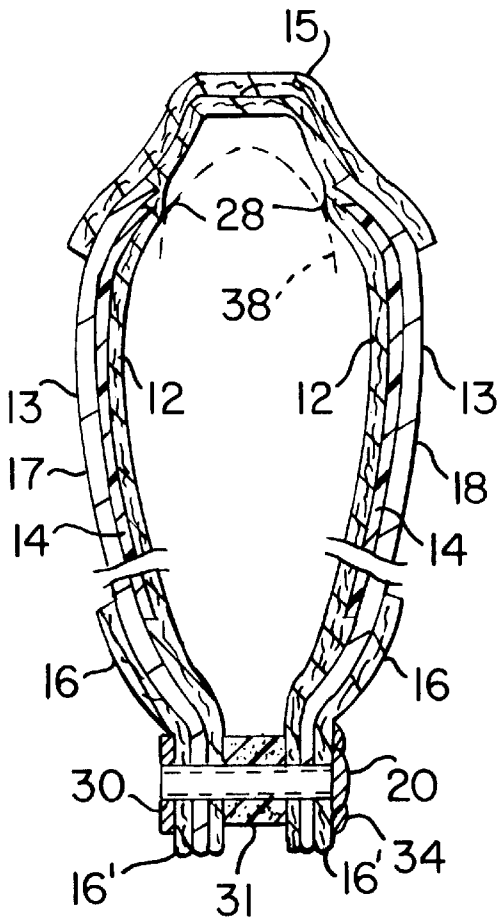
FIG. 2 is a cross-sectional view of the holster of FIG. 1 taken along line 2—2, a frame of the handgun being illustrated in broken lines.
Figure 3:
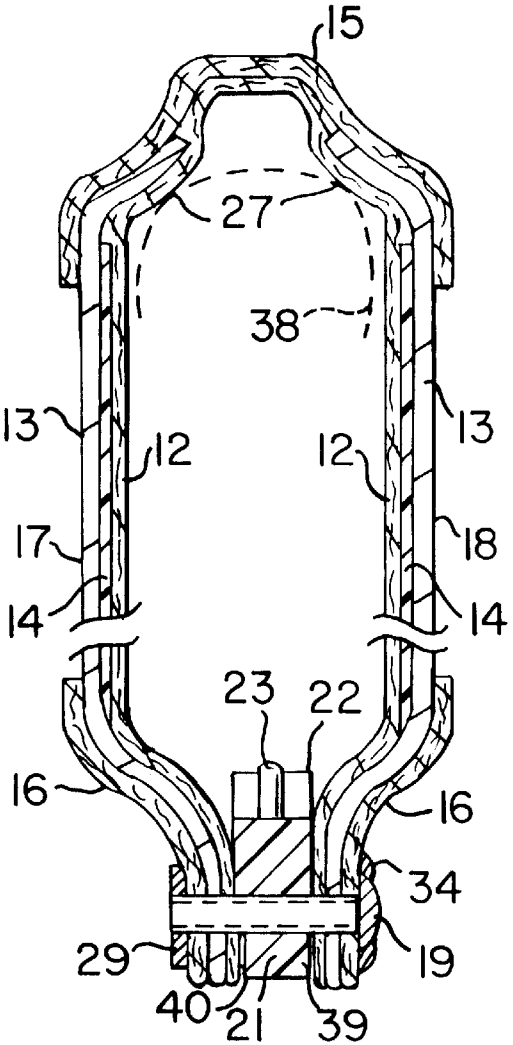
FIG. 3 is a cross-sectional view of the holster of FIG. 1 taken along line 3—3, a barrel of the handgun being illustrated in broken line.
Figure 4:
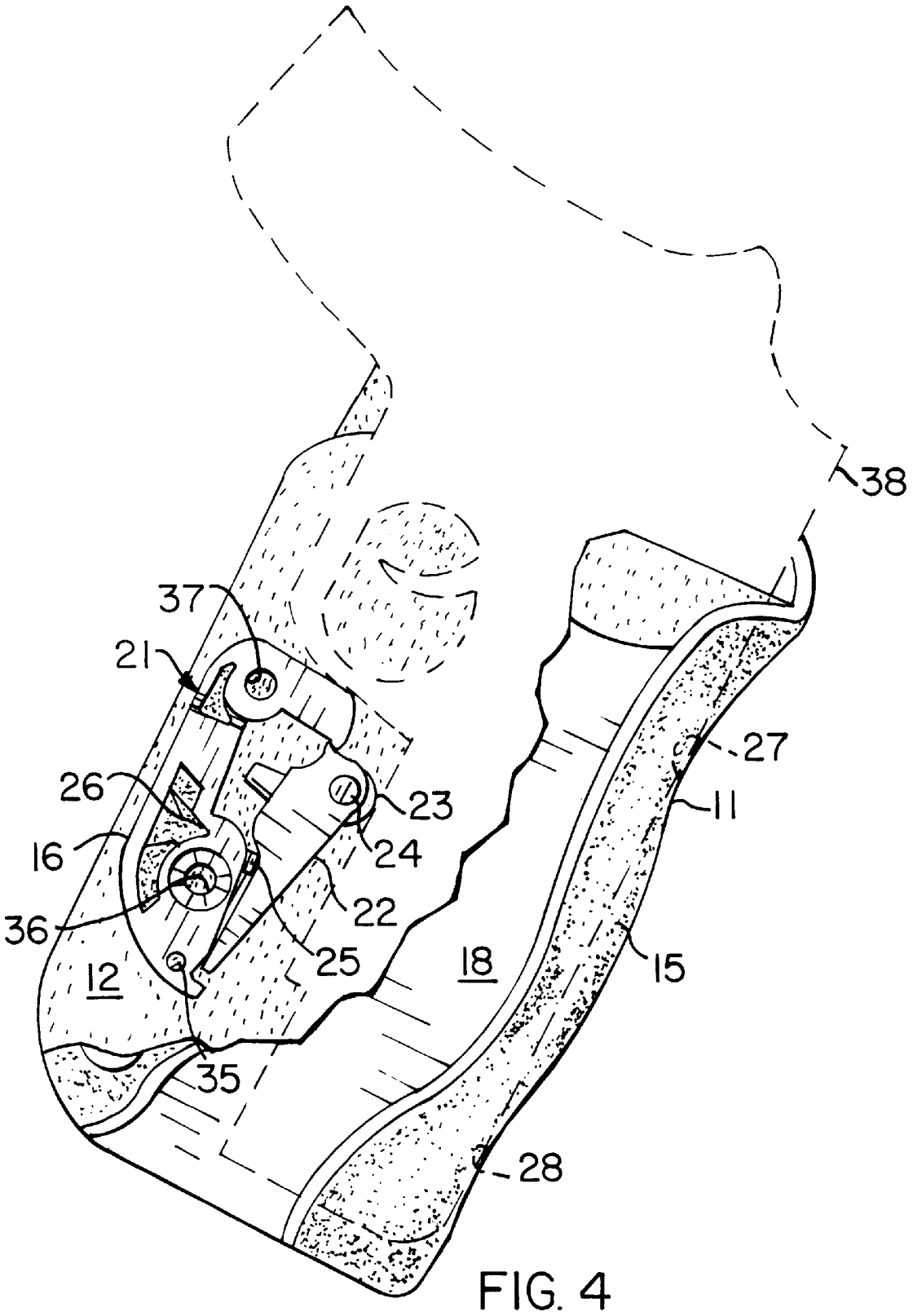
FIG. 4 is a side elevational view of the holster of FIG. 1 shown partially broken away to clearly illustrate the adjustment block device inside the holster.

With respect to FIG. 2, compressible spacer 31 fits between the lower portion of rear spine members 16. As adjustment screw 20 is tightened, spacer 31 is compressed and rear spine members 16 are brought closer together at the lower portions 16' which are curved slightly towards each other and reduces the bottom opening. This provides for greater frictional grasping of the holstered handgun 38 (shown in outline) adjacent its barrel at the lower portion of the holster 10. The contact points 28 illustrate the usual contact of the holster with a portion of the front top of the handgun 38, as illustrated in FIG. 4. Rear spine members 16 are substantially rigid but may be flexed upon application of a sufficient bending force. With respect to FIG. 3, a rigid non-compressible adjustment block 21 carries a rotatable wheel 23 mounted on a movable engaging arm member 22. The upper body portion 39 of block 21 is tapered to be narrow and to define spaces 40 between the upper body portion 39 and spine members 16. Accordingly, as adjustment screw 19 is tightened, the spine members 16 are flexed and brought closer together thereby changing the spacing between sidewalls 17 and 18 and the frictional force applied by the holster body 11 to the handgun 38. This adjustment is used primarily to adjust the force needed to draw a handgun 38 from the holster 10 and its concomitant holding of the handgun properly holstered. The upper contact surfaces 27 are in contact with the handgun 38 at points on the back top of the handgun adjacent the rear of the barrel, as shown in FIG. 4.

In FIG. 4, block 21 has an axle 24 in the arm 22 for mounting wheel 23 and two holes, 36 for mounting a screw 36" (shown in FIG. 6), and a hole 37 through which the upper adjustment screw 19 is threadedly engaged with T-nut 19'. Engaging arm member 22 carries wheel 23 and is pivotably mounted via pin 35 to the block 21. The position of wheel 23 and member 22 is selectively adjusted via adjustment screw 25 carried on threads 26 in the block 21. As screw 25 is moved forwardly, member 22 is pushed forwardly so that wheel 23 contacts handgun 38 at a point adjacent the trigger guard and barrel. This adjustment provides for the capability of holster 10 to accommodate a wide variety of handguns 38 dependent upon the size and shape of the slide and frame of the handgun 38. This feature combined with adjustments at screws 19 and 20 and in conjunction with contact surfaces 27 and 28 provides this single holster 10 to accommodate a wide variety of handgun 38 sizes and shapes and also includes user adjustments for the draw of the gun, as well as decreasing or increasing the bottom opening of the holster 10.

Figure 5:
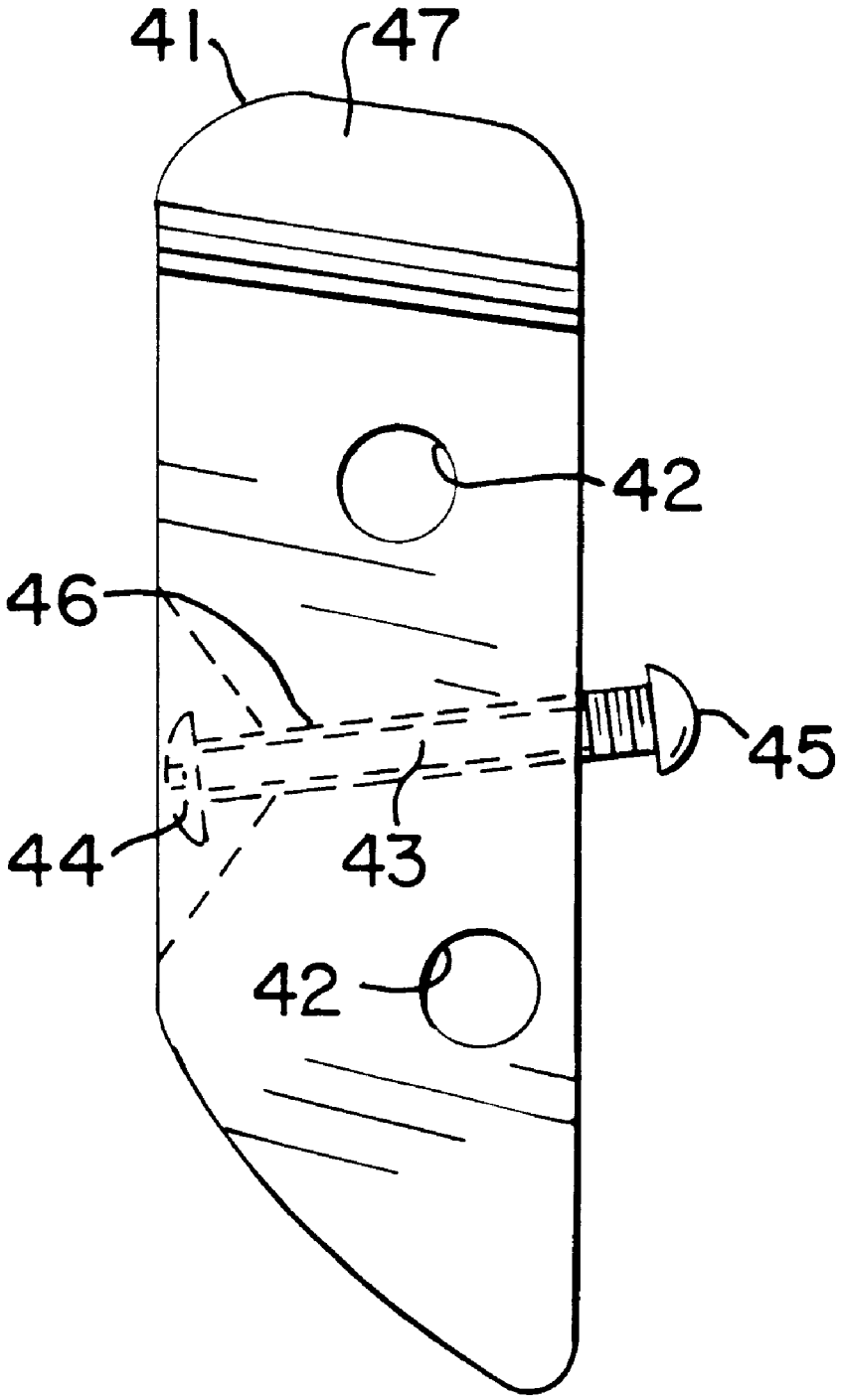
FIG. 5 is an alternate embodiment of the adjustment block device used to position a handgun in the holster of FIG. 1.

FIG. 5 illustrates a simpler, but not preferred, alternative adjustment block 41. Screw holes 42 are used to secure the block 41 to a holster 10. The adjustment member 43 is a rod-like threaded screw element with a notched head 44 and a domed engaging head 45 made of nylon or the like, non-marring to the handgun, that contacts the handgun 38 adjacent the trigger guard and slide similar to the engagement by wheel 23 described in connection with FIG. 4. The member 43 is carried in a threaded passageway or bore 46. The top of the block 41 has a narrow undercut portion 47 to provide for draw adjustment as discussed hereinabove in connection with FIGS. 1–4.

Figure 6:
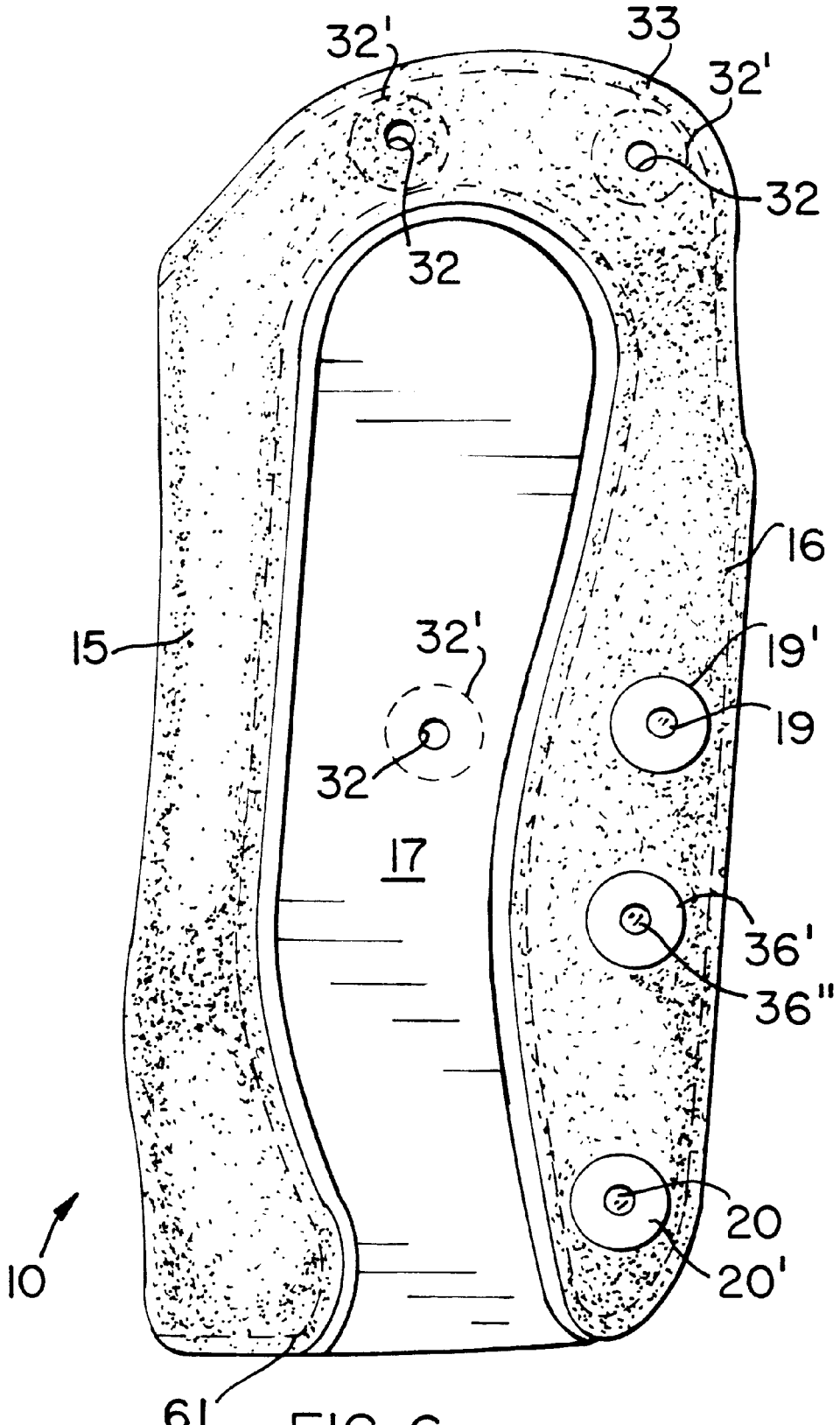
FIG. 6 is a rear elevational view of the holster of FIG. 1.
Figure 7:
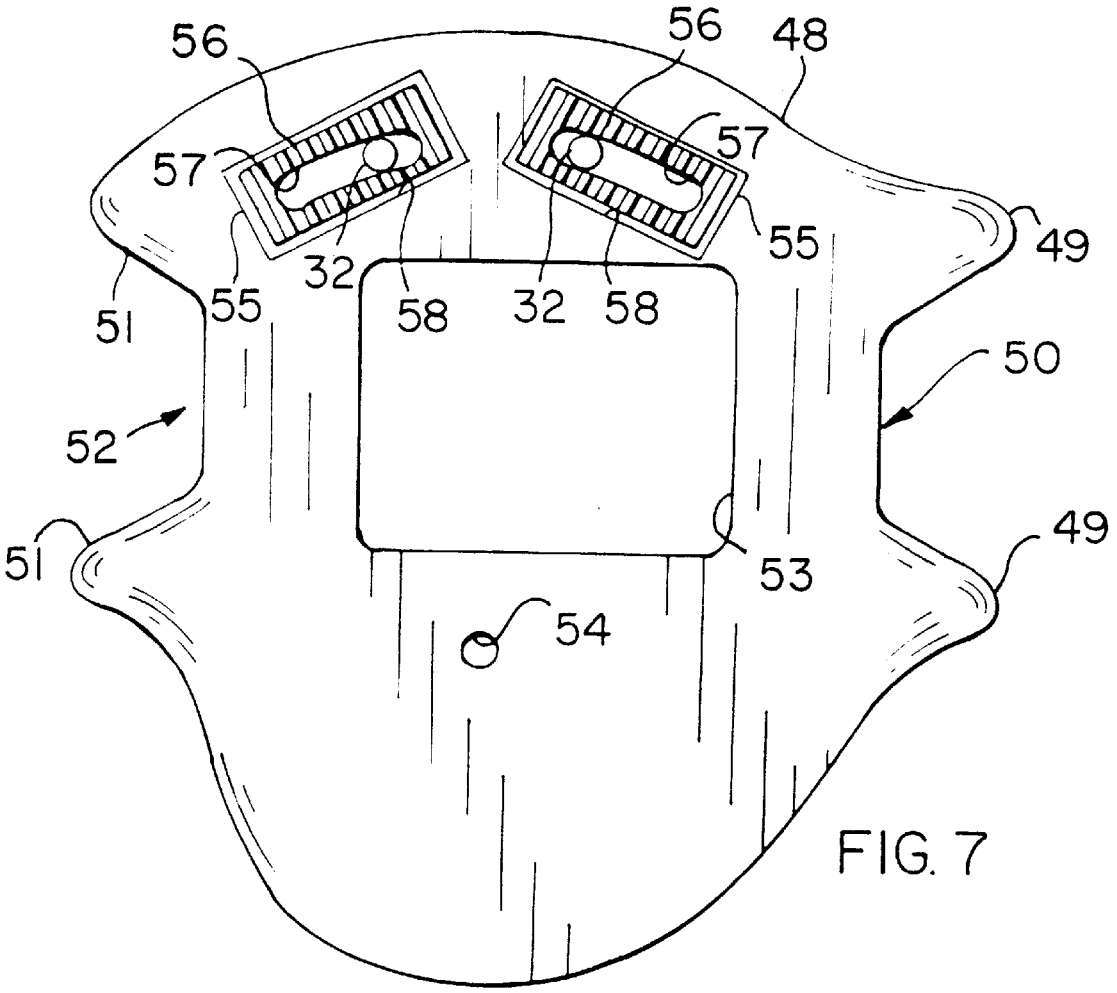
FIG. 7 is a plan view of a holster carrier for securing the holster to a user.
Figure 8:
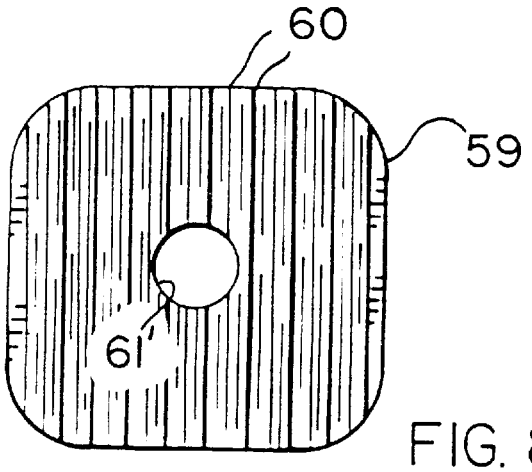
FIG. 8 is an enlarged view of the engaging washer used with the carrier of FIG. 7.

With respect to FIGS. 1 and 6, the holster body 11 has an upper rigid member 33 for mounting the holster 10 to a holster carrier 48, as shown in FIG. 7. T-nut bases 19', 20' secure integral threaded members 19, 20 in place to rear edge spine 16. T-nut 36' disposes screw 36" in line with hole 36 of block 21 or hole 42 of block 41 to affix same to holster 10. Ears 49 and 51 defining an open slot area 50 and 52 respectively. An opening 53 provides a space wherein a belt loop of a user's belt may protrude such that a belt of 1 inch to 1¾ inches width can be fitted into slots 50 and 52 over the outside of the adjacent surface that is accessible and through a loop in the opening 53. Opening 54 is aligned with a threaded member 32 in T-nut 32' for pivotally mounting the holster 10 to carrier 48. Two clamping zones 55 include arcuate slots 57 surrounded by sawtooth-shaped teeth 56. The teeth 56 and slot 57 are set inwardly into respective recesses 58. Two spaced threaded members 32 of T-nuts 32' fit within the respective slots 57. FIG. 8 illustrates a washer 59 having sawtooth-shaped teeth 60 complementary to those of teeth 56 adjacent slots 57. Zones 55 and respective screws (not shown) extend through openings 61' to secure the carrier 48 to the threaded members 32 rigidly attached to cross piece 33.

It is to be understood that the holster of this invention has been described in the preferred embodiment illustrated in FIGS. 1–4 and 6, with both sidewalls 17 and 18 having the ability to conform in shape and accept various handguns holstered therein with the foregoing described adjustments. However if it is desired to make the entire inside sidewall rigid and non-conforming, such holster may be acceptable to a limited degree of performance and likely would require additional holsters to accommodate the known and available semi-automatic handguns. The preferred embodiment will accommodate such handguns with only a few (3 or 4) holsters mainly due to the length of the barrels. Accordingly the basic invention includes, only at least one sidewall 18 with the conforming capabilities, but the preferred embodiment requires that both sidewalls 17 and 18 be conforming to the handgun.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

I claim:

1. An adjustable holster comprising a body formed of a pair of elongated sidewalls joined by an elongated front spine member and defining an interior space for a handgun, each said sidewall having an elongated rear spine member therealong, one said sidewall being formed of at least one layer of resiliently deformable non-compressible material, said layer of material being flexible and being substantially unstretchable, adjustable securing means for securing said rear spine members together, selective adjustment means mounted to one said rear spine member inside said interior space of said holster for selectively engaging a handgun located in said interior space to accommodate different shapes and sizes in said holster, and attachment means adapted to secure said holster to a strap to be carried by a user of said holster.

2. The holster as defined in claim 1 wherein said selective adjustment means includes a rigid body member and a movable engaging member carried by said body member, means for moving said engaging member against a surface of a handgun locatable in said holster for forcing a handgun against said front spine member to secure a handgun inside said holster.

3. The holster as defined in claim 1 wherein said front spine member has a predetermined contour being formed to frictionally contact a handgun at two spaced apart locations when placed in said holster for securing a handgun in said holster.

4. The holster as defined in claim 1 wherein said adjustable securing means includes a first adjustable fastener connecting said rear spine members together at upper portions thereof for selectively pulling said upper portions together, and second adjustable fastener connecting said rear spine member at lower portions thereof for selectively pulling said lower portions together.

5. The holster as defined in claim 1 wherein said front and rear spines are rigid.

6. The holster as defined in claim 1 wherein said front spine member is rigid and said rear spine member is substantially rigid and capable of being flexed upon application of a sufficient bending force.

7. An adjustable holster comprising a body formed of a pair of sidewalls joined by a front spine member and defining an interior space for a handgun, each said sidewall having a rear spine member, each said sidewall being formed of interior, exterior and core layers of deformable material, said core layer being located between said interior and exterior layers, said core layer being of resiliently deformable material and being flexible and being substantially nonstretchable, adjustable securing means for securing said rear spine members together, selective adjustment means mounted to said holster inside said interior space of said holster for selectively engaging a handgun located in said interior space to cause said holster to secure handguns of different shapes and sizes in said holster, and attachment means for connecting said holster to a strap worn by a user of said holster.

8. The holster as defined in claim 7 wherein said rear spine members have upper portions each having a first passageway therethrough, said selective adjustment means comprising a rigid body member having a lower portion and an upper portion each having opposite sidewalls and a second passageway therethrough, said upper portion being narrower in width than said lower portion to define a space between said upper portions of said rear spine members and said opposite sidewalls of said body member, said selective adjustment means including securing means positioned through both said first passageways and said second passageway for pulling said rear spine members toward each other and said sidewalls of said body member toward each other to selectively narrow said interior space for adjusting the frictional engagement between said sidewalls of said holster and a handgun locatable in said space.

9. The holster as defined in claim 7 wherein said selective adjustment means includes a rigid body member and a movable engaging member carried by said body member, means for moving said engaging member against a surface of a handgun locatable in said holster for forcing a handgun against said interior layer adjacent said front spine member to secure a handgun inside said holster.

10. The holster as defined in claim 9 wherein said front spine member being formed to frictionally contact a handgun in at least one contact point thereof when said engaging member is in contact with a handgun, said at least one contact point and said engaging member cooperating to secure a handgun in said holster.

11. The holster as defined in claim 7 wherein said rear spine members include lower portions each having a passageway therethrough, said adjustable securing means including selectively operable fastener means positioned through said passageways and a compressible spacer means located between said lower portions of said rear spine members, said spacer means being compressed by selective operation of said fastener means to narrow said interior space in said holster to secure a handgun therein.

12. The holster as defined in claim 7 wherein said attachment means includes a rigid cross member attached to an upper portion of one said sidewall for attaching said holster to a strap for carrying said holster by a user.

13. The holster as defined in claim 7 wherein said front spine member has a predetermined contour being formed to frictionally contact a handgun at two spaced apart locations when placed in said holster for securing a handgun in said holster.

14. The holster as defined in claim 7 wherein said front spine member is formed to frictionally contact a handgun placed inside said holster at two spaced locations, one said location being adjacent a front top of a handgun and another said location being at a back top of a handgun.

15. The holster as defined in claim 7 wherein said selective adjustment means includes rigid body member and a movable engaging member carried by said body member, screw means carried by said body member and in contact with said engaging member, said screw means operable for moving said engaging member against a surface of a handgun locatable in a holster for forcing a handgun forwardly against said interior layer adjacent said front spine member to secure a handgun inside said holster.

16. The holster as defined in claim 7 wherein said adjustable securing means includes a first fastener connecting said rear spine members together at upper portions thereof, and a second fastener connecting said rear spine member at lower portions thereof.

17. An adjustable holster comprising a body formed of a pair of sidewalls joined by a front spine member and defining an interior space for a handgun, each said sidewall having a rear spine member, each said sidewall being formed of interior, exterior, and core layers of resiliently deformable noncompressible material therebetween, said core layer of resiliently deformable noncompressible material being flexible and being substantially nonstretchable, adjustable securing means for securing said rear spine members together, selective adjustment means mounted to said rear spine members inside said interior space of said holster for selectively engaging a handgun located in said interior space to enable different shapes and sizes of handguns to occupy said interior space of said holster, and attachment means for securing said holster to a strap to be worn by a user of said holster.

18. The holster as defined in claim 17 wherein said rear spine members have upper portions each having a first passageway therethrough, said selective adjustment means comprising a rigid body member having a lower portion and an upper portion each having opposite sidewalls and a second passageway therethrough, said upper portion being narrower in width than said lower portion to define a space between said upper portions of said rear spine members and said opposite sidewalls of said body member, said selective adjustment means including securing means positioned through both said first passageways and said second passageway for pulling said rear spine members inwardly toward each other and said sidewalls of said body member toward each other to selectively narrow said interior space for adjusting the frictional engagement between said sidewalls of said holster and a handgun locatable in said space.

19. The holster as defined in claim 17 wherein said selective adjustment means includes a rigid body member and a movable engaging member carried by said body member, means for moving said engaging member against the surface of a handgun located in said holster for forcing a handgun against said interior layer adjacent said front spine member to secure a handgun inside said holster.

20. The holster as defined in claim 17 wherein said engaging member includes a movable arm member having an upper portion and a lower portion and pivot means for pivotally mounting said arm member to said body member at said lower portion of said arm member, and a rotatable wheel, axle means carried by said upper portion of said arm member for rotatably mounting said wheel thereon.

21. The holster as defined in claim 17 wherein said front spine member being formed to frictionally contact a handgun placed inside said holster at two spaced locations, one said location being adjacent the front top of a handgun and another said location being adjacent at the back top of a handgun.

22. The holster as defined in claim 21 wherein said front spine member being formed to frictionally contact a handgun in at least one contact point thereof when said engaging member is in contact with a handgun, said at least one contact point and said engaging member cooperating to secure a handgun in said holster.

23. The holster as defined in claim 17 wherein said front and rear spines are rigid.

24. The holster as defined in claim 17 wherein said front spine member is rigid and said rear spine member is substantially rigid and capable of being flexed upon application of a sufficient bending force.

* * * * *